US011065169B2

(12) United States Patent
Sinclair

(10) Patent No.: US 11,065,169 B2
(45) Date of Patent: Jul. 20, 2021

(54) CONVERTIBLE EXAMINATION TABLE

(71) Applicant: Mark Sinclair, North Miami Beach, FL (US)

(72) Inventor: Mark Sinclair, North Miami Beach, FL (US)

( * ) Notice: Subject to any disclaimer, the term of this patent is extended or adjusted under 35 U.S.C. 154(b) by 872 days.

(21) Appl. No.: 15/684,368

(22) Filed: Aug. 23, 2017

(65) Prior Publication Data

US 2019/0060151 A1 Feb. 28, 2019

(51) Int. Cl.

| | |
|---|---|
| ***A47C 17/13*** | (2006.01) |
| ***A47C 17/16*** | (2006.01) |
| ***A61G 13/00*** | (2006.01) |
| ***A61G 13/02*** | (2006.01) |
| ***A61G 15/00*** | (2006.01) |
| *A61G 13/12* | (2006.01) |
| *A61G 13/08* | (2006.01) |
| *A61G 7/16* | (2006.01) |

(52) U.S. Cl.

CPC ..... *A61G 13/0018* (2013.01); *A61G 13/02* (2013.01); *A61G 15/002* (2013.01); *A61G 7/16* (2013.01); *A61G 13/08* (2013.01); *A61G 13/1285* (2013.01)

(58) Field of Classification Search

CPC ..... A47C 17/13; A47C 17/132; A47C 17/134; A47C 17/136; A47C 17/138; A47C 17/16; A47C 17/161; A47C 17/162; A47C 17/163; A47C 17/165; A47C 17/1655; A47B 83/02; A47B 83/021; A47B 83/0213; A47B 83/0215; A47B 2083/025

See application file for complete search history.

(56) References Cited

U.S. PATENT DOCUMENTS

| | | | | | |
|---|---|---|---|---|---|
| 89,776 | A * | 5/1869 | Jones | A47C 3/16 | 5/7 |
| 242,941 | A * | 6/1881 | Laeremans | A47C 17/1655 | 5/43 |
| 341,140 | A * | 5/1886 | Haight | A47C 3/16 | 5/7 |
| 509,277 | A * | 11/1893 | Woodman | A47B 85/04 | 297/127 |
| 539,231 | A * | 5/1895 | McKee | A61G 7/015 | 5/618 |
| 559,927 | A * | 5/1896 | Balke | A63D 15/04 | 473/10 |
| 786,693 | A * | 4/1905 | Stone | A47B 85/04 | 297/128 |

(Continued)

OTHER PUBLICATIONS

International Search Report and the Written Opinion in PCT/US2018/047523. pp. 1-8.

*Primary Examiner* — Peter M. Cuomo
*Assistant Examiner* — Ifeolu A Adeboyejo
(74) *Attorney, Agent, or Firm* — Ted Whitlock; Santucci Priore, PL

(57) ABSTRACT

There is provided herein an examination table that is capable of being converted to render either an examination configuration or a seating configuration. The table includes a planar table member having a suitable surface for the examination of a subject and is adjustable between a horizontal orientation for medical evaluation of the subject and a vertical orientation when in the table member is not in use for exams.

10 Claims, 9 Drawing Sheets

(56) References Cited

U.S. PATENT DOCUMENTS 816,616 A * 4/1906 Stone ..... A47B 85/04 297/127
1,207,510 A * 12/1916 Decker ..... A47B 85/04 297/128
1,271,830 A * 7/1918 Austin ..... A47B 85/04 297/128
1,413,593 A * 4/1922 Kreuzkamp ..... A47C 17/32 5/58
2,193,647 A 3/1940 Rush et al.
2,532,355 A 12/1950 Brown
3,016,275 A * 1/1962 Grant ..... A61G 13/0018 312/209
3,048,855 A 8/1962 Frank
3,341,198 A * 9/1967 Turpin, Sr. ..... A63D 15/04 473/10
3,667,803 A * 6/1972 Ford ..... A47B 85/00 297/119
3,913,973 A 10/1975 Mintz et al.
4,297,752 A 11/1981 Dick
4,476,592 A 10/1984 Reppas et al.
5,098,153 A * 3/1992 Antoine ..... A47C 4/52 297/17
5,136,737 A 8/1992 Reppas et al.
5,280,656 A 1/1994 Gossett
5,727,844 A * 3/1998 O'Quinn ..... A47C 3/16 206/216
6,113,182 A * 9/2000 Wise ..... A47B 85/06 108/13
6,508,526 B2 1/2003 Reppas et al.
6,934,979 B2 8/2005 Swan
7,020,911 B2 4/2006 Oldham
8,132,856 B2 * 3/2012 Wilson ..... A47C 17/86 297/188.01
9,004,585 B1 4/2015 Pidgornyy
9,314,104 B2 4/2016 Stieglitz et al.
10,251,488 B2 * 4/2019 Lan ..... A47C 9/002
2008/0189851 A1 8/2008 Griepentrog
2012/0131745 A1 5/2012 Wieland et al.

* cited by examiner

CONVERTIBLE EXAMINATION TABLE

FIELD OF INVENTION

The present invention generally relates to convertible furniture units or assemblies that can assume different configurations to provide different functions. More particularly, the present invention relates to medical and clinical furniture and apparatus that is convertible between two or more functional modes.

BACKGROUND OF THE INVENTION

Convertible furniture assemblies are well known and have been utilized extensively in home environments as well as industry and office environments for years in order to maximize the use of space. For example, U.S. Pat. No. 4,297,752 discloses a convertible furniture unit wherein the backrest and the armrest can be removed for conversion into a daybed while U.S. Pat. Nos. 7,020,911 and 9,004,585 disclose multi-functional furniture assemblies having interchangeable parts that can be reconfigured in a variety of ways to form different functional pieces.

Other examples include U.S. Pat. No. 6,934,979 which discloses a hospital room bench that easily converts into a bed for individuals staying overnight with an inpatient. U.S. Pat. Nos. 4,476,592 and 6,508,526 disclose a bed that can be converted to a loveseat or a desk, respectively.

Still other examples include specific medical grade apparatus such as that disclosed in U.S. Pat. No. 8,479,329. In particular, the '329 patent discloses a medical examination table comprises a base that provides for a storage area and a patient support having a backrest and a seat. The patient support can be moved independently from the base and can be raised or lowered as well as reclining to an flat examination surface. U.S. Pat. No. 7,665,166 discloses a wheelchair-examination table combination and a system for connecting a wheelchair to an examination table while U.S. Pat. No. 7,600,280 discloses a patient examination table having multiple folding configurations.

Despite the numerous and various types of convertible furniture units afforded by the prior art, there remains a need for new and improved clinical examination room assemblies that can be quickly and easily converted from one functional mode to another to maximize the limited floor space typically encountered in examination rooms where space is at premium.

Accordingly, it would be desirable to have an examination table that saves space by readily and easily converting into a seating unit, especially one having a less clinical, more aesthetically pleasing appearance. Such a device would be advantageous for the clinician since the look and feel of the examination room can be quickly converted into one that more approximates a home or waiting room environment so as to reduce patient anxiety when the patient initially enters the examination room.

SUMMARY OF THE INVENTION

The present invention is directed to an examination table that is capable of being converted between an examination configuration for performing a medical examination of a patient in a medical clinic or hospital environment and a seating configuration.

The examination table according to the subject invention includes at least one planar table member having a suitable surface or examination face for the examination of a subject or patient and a non-examination face. The table member is adjustable between a horizontal orientation for medical evaluation of the subject and a vertical orientation when in the table member is not in use for exams.

The examination table also includes a base for supporting the table member when it is horizontally oriented. The base includes a front and a back. It also includes a first and a second end member that are both substantially vertical orientation relative to the floor and are substantially the same height in order to provide support for the planar table member when in the horizontal orientation. The base further includes at least one substantially planar seating member that is disposed between and connects to the first and second end members to form a horizontal seating surface suitable for seating patients.

The table member and the base are hingedly affixed to one another to allow the table member to pivot between the vertical and horizontal orientations. The examination face of the table member faces up when the table member is pivoted forward to the horizontal orientation and affords access to the horizontal seating surface when in the vertical orientation.

The base may be fashioned as a support frame wherein the front and the back are oriented substantially parallel to one another and wherein the first and the second end member connect the front to the back at the ends to form a substantially rectangular, free standing structure. The examination face of the table member may optionally comprise padding or stainless steel. The table member may also optionally include one or more extension trays to increase the surface area available for examination.

As will be further appreciated from the detailed description below, the base and/or table member may optionally include one or more features to impart added functionality and convenience to the examination table of the present invention. By way of example only, such features include extendable trays and footsteps, storage drawers, lighting devices, brackets, holsters, extension arms and electrical power outlets as well as ports for connecting and/or charging laptop computers (e.g. USB ports) or other devices such as medical instrumentation. For example, the base may optionally include one or more extendable footsteps or storage drawers for convenience and functionality.

When the base is fashioned as a support frame, it may optionally include a back frame support member disposed between and connected to the first and second end members. The back frame support member may be used to hingedly affix the frame to the planar table member. It will be appreciated by those skilled in the art that the table member and the back of the frame may be hingedly affixed to one another in various locations since the back of the frame may be fashioned in multiple embodiments. In one basic embodiment, the planar table member is hingedly affixed to the back of the frame at the top of the end members, the details of which will be further appreciated by the drawings and detailed description set forth below.

The back frame support member may be fashioned as a solid panel or fashioned in accordance with other embodiments discussed below. For example, the back support member may be a backrest as well as providing additional rigidity and stability for the support frame. It may also provide support for optional, ergonomically designed backrest member which may fold forward to afford proper placement of the planar table member when the examination table is in the examination configuration When the planar table member is placed in the horizontal orientation, an examination "platform" is created. When not in use for an examination procedure, the table member is capable of being pivoted up and away from the horizontal orientation into a vertical orientation in order to provide access to the seating surface afforded by the seating member.

Accordingly, the examination table of the present invention is useful in a clinical environment due to its rapid convertibility between an examination configuration for performing a medical examination of a patient and a seating configuration. A physician or other staff member may engage in a more relaxed conversation about the patient's health or any pertinent health history, clinical symptoms, laboratory or imaging results, upcoming procedures, hospital stays, treatment plans, disease progression, prognosis or the like.

The environment afforded by the present invention is especially advantageous when the physician or other staff member may have to discuss sensitive or emotional issues associated with the foregoing. At any point in the patient-physician/staff interaction, the present invention may be readily converted from the seating configuration to the examination configuration by pivoting the table member of the present invention from the vertical orientation forward to the horizontal orientation. Accordingly, the present invention allows the physician to make a fluid transition between a more relaxed, conversational environment to a more clinical, technical environment.

Importantly, the prior art does not provide for a space-saving examination table that is capable of a rapid conversion between an examination mode and a seating mode utilizing a supporting base hingedly affixed to a table member that folds or pivots forward onto the base to form horizontal examination platform.

Accordingly, herein is provided various embodiments, features and advantages of the present invention that will be apparent to those of ordinary skill in the art in view of the following detailed description of the invention and accompanying drawings.

BRIEF DESCRIPTION OF THE DRAWINGS

The drawings as provided for herein set forth exemplary embodiments of the present invention, the detailed description of which follows hereinbelow. The drawings are merely exemplary and are clearly not intended to limit the invention as encompassed by the claims appended herewith.

DETAILED DESCRIPTION OF THE INVENTION

The following description is made in general reference to FIGS. 1-8 and is provided herewith solely to illustrate exemplary embodiments of the present invention.

In accordance the present invention, there is described herein a examination table that is capable of being converted between an examination configuration and a seating configuration. Referring to the figures, preferred embodiments of the subject device are shown.

Figure 1A:
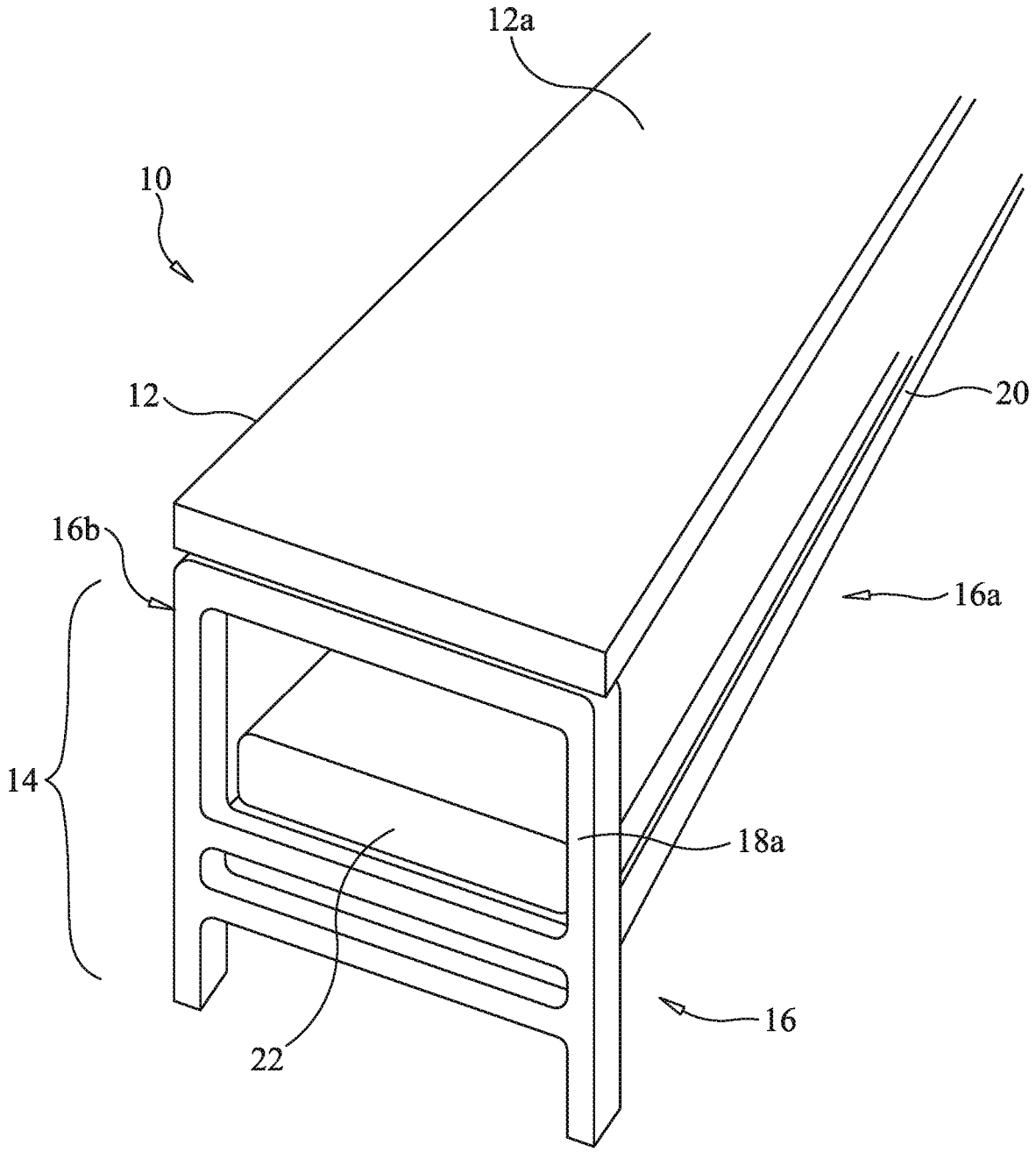
FIGS. 1*a* and 1*b* are perspective views of the examination table of the present invention while in the examination mode and in the non-examination seating mode, respectively.
Figure 1B:
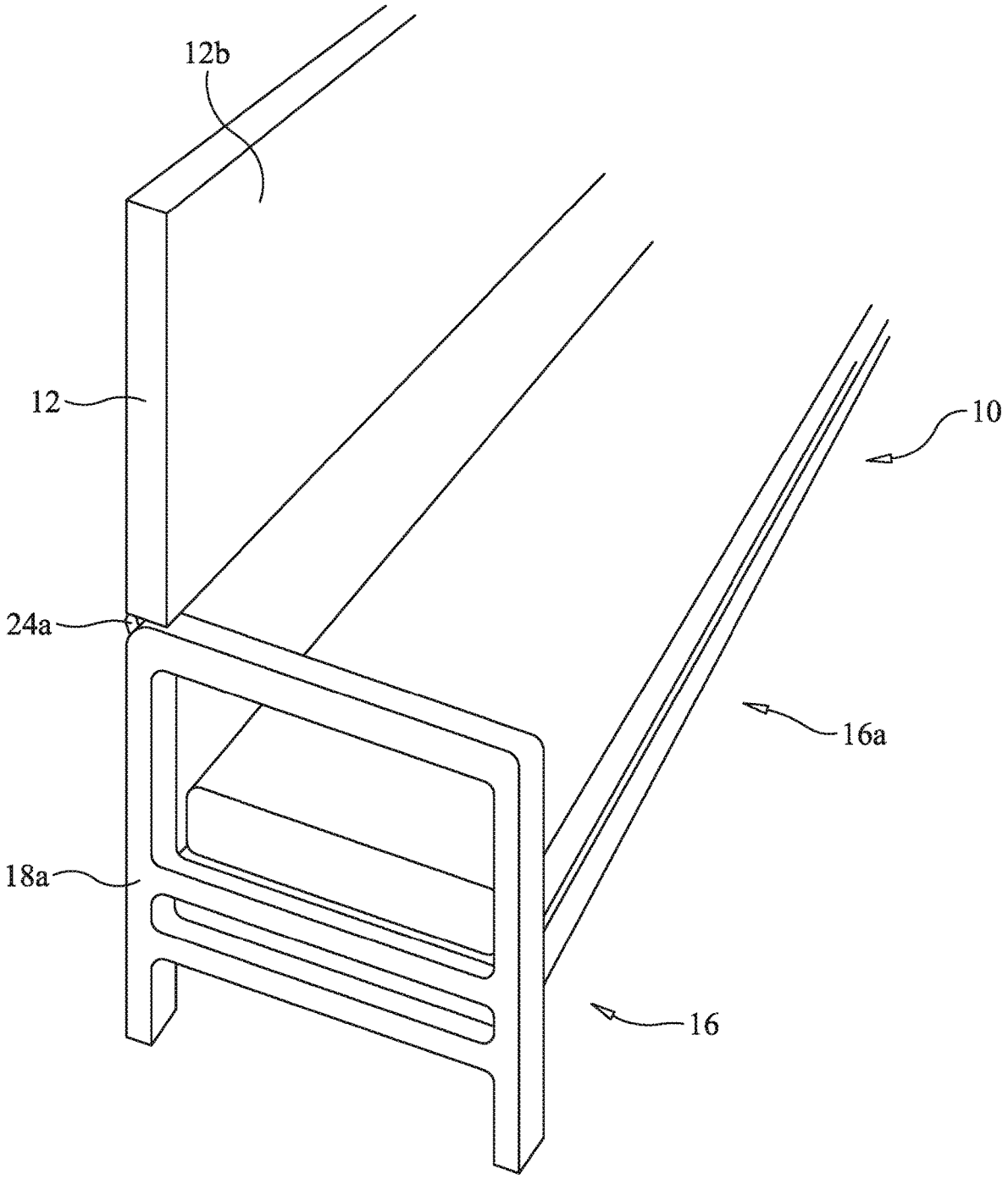

FIGS. 1*a* and 1*b* provide perspective views of one general embodiment of the present invention. More particularly, FIGS. 1*a* and 1*b* show examination table 10 wherein base 14 is exemplified as support frame 16. Turning to FIG. 1*a*, table 10 is shown in an examination mode where it has been configured to position planar table member 12 in a horizontal orientation with examination face 12*a* facing up and non-examination face 12*b* (not shown) facing down. This positioning accommodates a subject either seated thereon or lying horizontally or prone on table member 12 in order to undergo a medical evaluation. FIG. 1*b* shows examination table 10 in a seating mode where it has been configured to position planar table member 12 in a vertical orientation with non-examination surface 12*b* facing the front of support frame 16.

Referring again to FIGS. 1*a* and 1*b*, planar table member 12 is shown generally supported by base 14. While it will be appreciated by those skilled in the art that base 14 may be fashioned in multiple embodiments, it may comprise a support frame 16 having a front denoted in the figures as 16*a* and a back denoted as 16*b*. In this embodiment, front 16*a* and back 16*b* will generally be substantially parallel to one another and are joined at the ends by end members 18*a* and 18*b* (18*b* not shown) to form substantially rectangular, freestanding supporting frame 16.

Base 14 also includes at least one substantially planar seating member 20 that is disposed between and connected to end members 18*a* and 18*b*. It will be appreciated by those skilled in the art of furniture and equipment manufacturing that planar seating member 20 is connected to the end members and supported within frame 16 by either a number of suitable attachment or joining means known to the art such as brackets, bolts, screws or the like. Alternatively, frame 16 can be fashioned with end members 18*a* and 18*b* and planar seating member 20 formed integrally into the frame during the manufacturing process by any suitable means known in the furniture fabrication arts. It will also be appreciated that while seating member 20 may be fashioned in a variety of ways out of a variety of materials, it should be suitable to form a horizontal seating surface that is sufficient to receive the weight of patients or other persons seated thereon.

A plurality of embodiments available for the construction of the seating members is known in the art and commercially available. Generally, any number of seating members deployed in sofas, recliners, chairs, or the like may be easily adapted for use in the present invention by those skilled in the art. For example, seating member 20 may be a substantially planar platform provided as a bench-like seating arrangement or fashioned as upholstery straps configured as a support webbing. Alternatively, the seating member can include a separate seat member that can be curved or shaped to conform to the curvature of the human body for purposes of providing ergonomic comfort of a patient while seated. In another embodiment, the seating member can further include one or more removable seat cushion members 22 that could be covered in a variety of materials including leather, fabric, polyvinyl, and the like. Alternatively, seating member 20 may be fabricated with cushion member 22 permanently affixed to the seating member.

Referring again to FIGS. 1*a* and 1*b*, it can be seen that the end members will be fashioned with a substantially vertical orientation and will have substantially the same height as one another in order to provide the primary support for planar table member 12 when the table member is pivoted forward to reside in the horizontal orientation. Additionally, in certain embodiments of the present invention, supporting frame 16 may include a back-rest member and/or an optional back frame support member running longitudinally along the back of the frame at approximately the same height as the end members in order to provide additional support for table member 12 as shown in FIG. 2*c*, the particulars of which will be further addressed below. The back frame support member can be solid or comprise one or more slats.

Figure 2A:
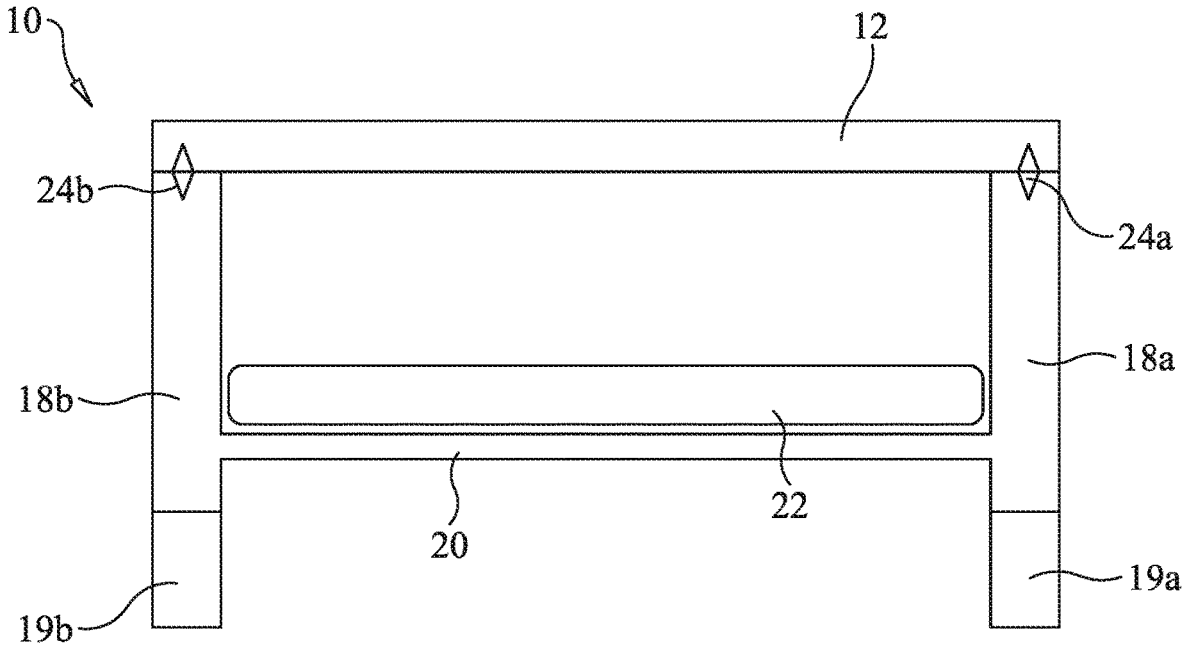
FIG. 2*a* is a back view of the examination table of FIG. 1*a* showing an optional height adjustment mechanism.

Referring now to FIG. 2*a*, which shows the back of the examination table of the present invention, table member 12 is hingedly affixed to end members 18*a* and 18*b* by hinges 24*a* and 24*b*, respectively. Various types of suitable hinge members are commercially available but should possess sufficient strength and durability to accommodate the weight of table member 12 which may undergo continued repositioning throughout the day between the horizontal orientation for the examination mode and the vertical orientation for the seating mode as shown in FIGS. 1*b* and 2*b*.

FIG. 2*a* also illustrates optional height adjustment mechanism 19*a* and 19*b* which can be affixed to the end members to raise and lower the base, shown as a support frame. This option is especially advantageous for adjusting the overall height of the examination table during an examination procedure to accommodate the height of the clinician or for performing certain procedures where a variation in the height of the table is also advantageous. Those skilled in the art of engineering and structural design will appreciate that a variety of height adjustment mechanisms are available in the marketplace and may be attached as an add-on feature or can be incorporated during the manufacturing of the exam table of the present invention. It will be further appreciated that these commercially available height adjustment mechanisms can be readily adapted for incorporation within base 14 at any position on the base that is contemplated to be in contact with the floor so long as the structural integrity of the base at the point of attachment is of sufficient strength so as to avoid compromising the stability or rigidity of examination table 10 when undergoing a height adjustment or when receiving the weight of an individual in either the seating or examination modes.

Figure 2B:
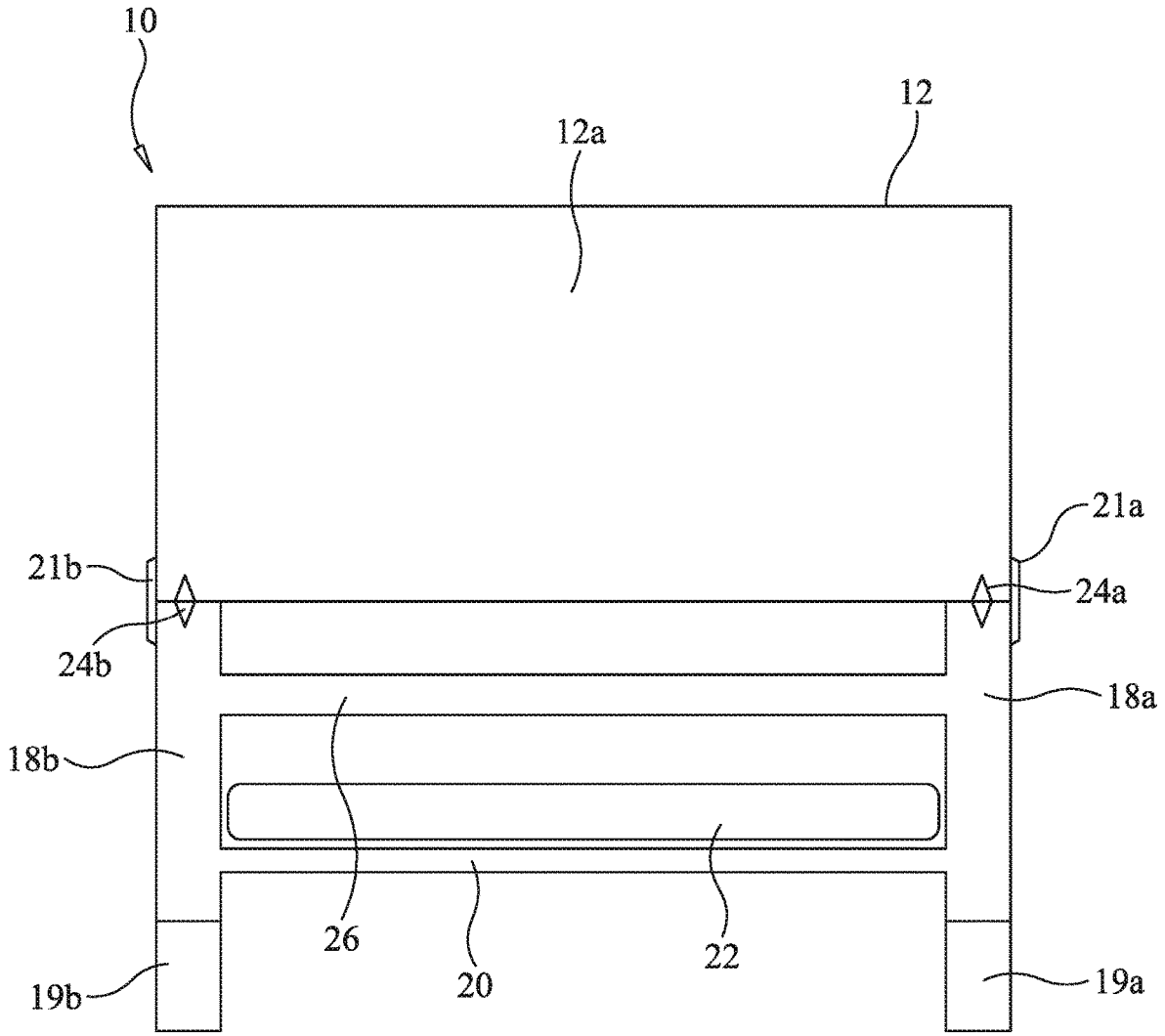
FIG. 2*b* is a back view of the examination table of FIG. 1*b* showing an optional back frame support member disposed between the end members.
Figure 2C:
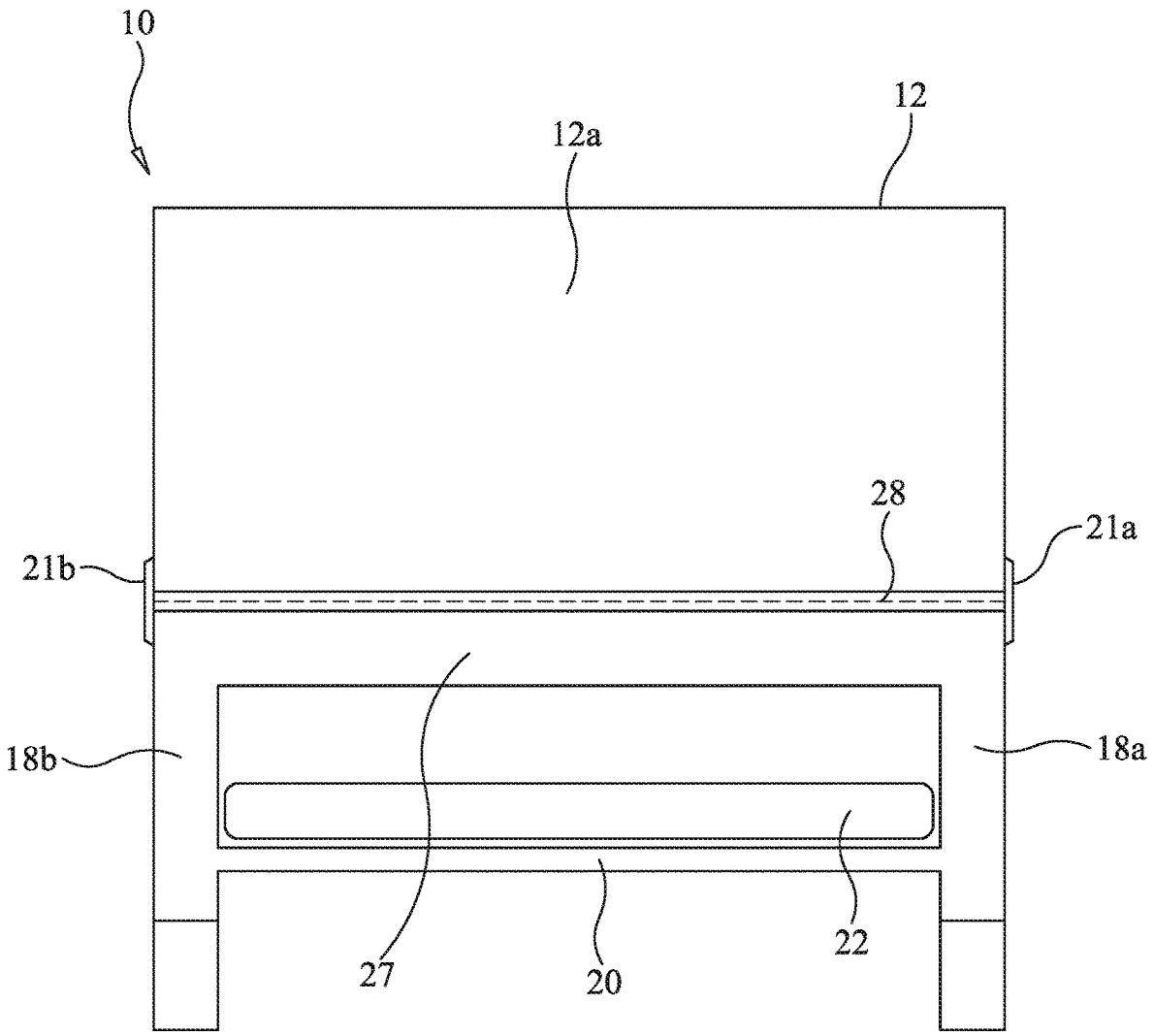
FIG. 2*c* is a back view of the examination table of FIG. 1*b* showing an alternative placement of an optional back frame support member and a longitudinal pivot hinge affixing the planar table member to the frame.

Turning now to FIGS. 1*b* and 2*a*-*c*, it will be apparent that planar table member 12 will need to be safely secured in the vertical orientation when the examination table is in the seating mode in order to prevent injury to persons seated on seating member 20. Those skilled in the art will appreciate that there are multiple locking hinge mechanisms commercially available that are suitable to safely maintain table member 12 in the vertical orientation. Additionally, examination table 10 may be optionally equipped with support struts 21*a* and 21*b* as shown in FIG. 2*b* which are attached to and extend between frame 16 and table member 12, thereby providing an alternative and/or supplemental method for safely securing table member 12 in the vertical orientation. Moreover, table member 12 may be fabricated with a wall latch mechanism that provides an additional means for securing table member 12 in an upright or vertical orientation when placed against a wall of the examination room.

It will be further appreciated that non-examination face 12*b* may be aesthetically fabricated with any number of available decorative embodiments including designs, laminates and the like in order to foster the look and feel desired by the clinician provided that the choice of embodiments does not impede the ability of table member 12 to rest squarely on base 14 with sufficient strength and stability.

FIGS. 2*b* and 2*c* provide alternative back views of the examination table shown in FIG. 1*b* but with slight modifications to illustrate optional back frame support members 26 and 27 interposed between end members 18*a* and 18*b* at the back of frame in alternate positions to form alternative embodiments of frame 16. The presence of the back frame support members 26 and 27 function to impart improved stability to frame 16 and may simultaneously function as a back-rest member to impart added comfort to persons seated on seating member 20. It will be readily appreciated that such back-rest members can be curved or shaped to conform to the curvature of the human body for purposes of providing ergonomic comfort of a patient while seated. a back frame support member disposed between and connected to the first and second end members at the back of the frame Importantly, the present invention contemplates various embodiments involving a back frame support member. For example, members 26 or 27 may be fashioned as a solid member spanning from end member 18*a* to 18*b* so as to take on a church pew or standard sofa configuration. In such configurations, removable cushions or sofa type pillows could be placed against the additional frame member to provide added comfort for seated individuals.

It will be appreciated that despite the configuration of the back frame support member, it should not impede the capability of planar table member 12 to squarely rest upon the end members for support when it the horizontal position. As such, the top of the back frame support member should be of a height not to exceed that of the end members or it should be either capable of quick removal or repositioning to a position that does not impede horizontal positioning of table member 12.

Turning to FIG. 2*c*, it will be appreciated that back frame support member 27 may include a longitudinal pivot hinge 28 running partially or entirely along its length. In this embodiment, hinge 28 functions to hingedly affix table member 12 to frame 16 rather than having table member 12 affixed to frame 16 by virtue of the end members as shown in FIGS. 2*a* and 2*b*. This type of longitudinal hinge provides additional support and durability for the point of attachment. It will of course be appreciated that table member 12 may still be hingedly affixed to frame 16 by virtue of the end members as shown in FIGS. 2*a* and 2*b* despite the presence of back frame support member 27.

Figure 3A:
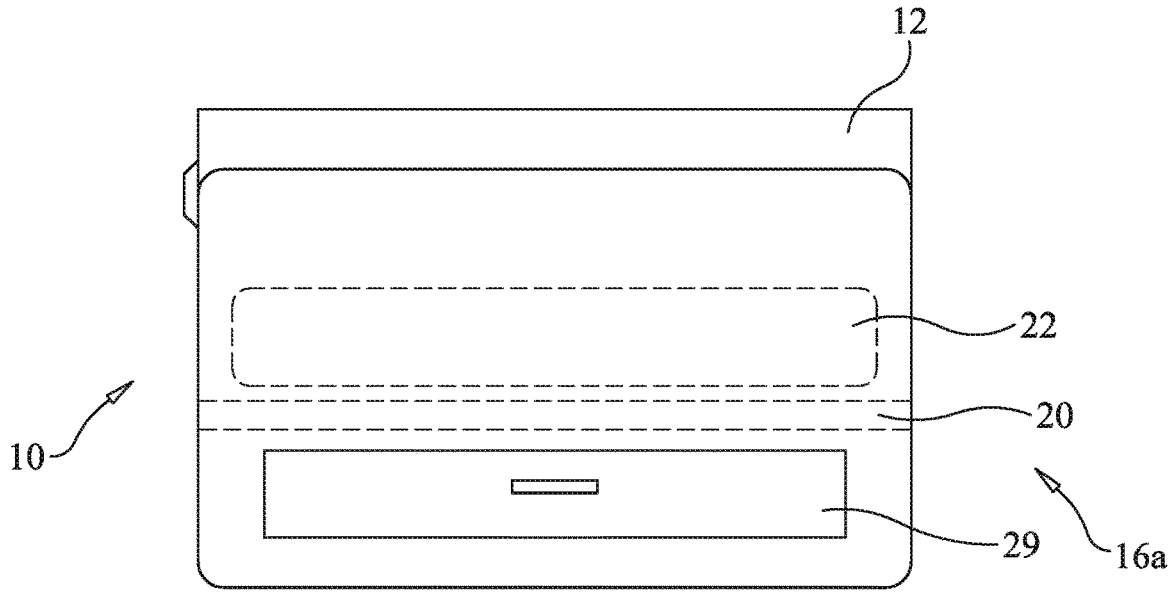
FIGS. 3*a* and 3*b* show end views of two exemplary embodiments of the examination table of the present invention.
Figure 3B:
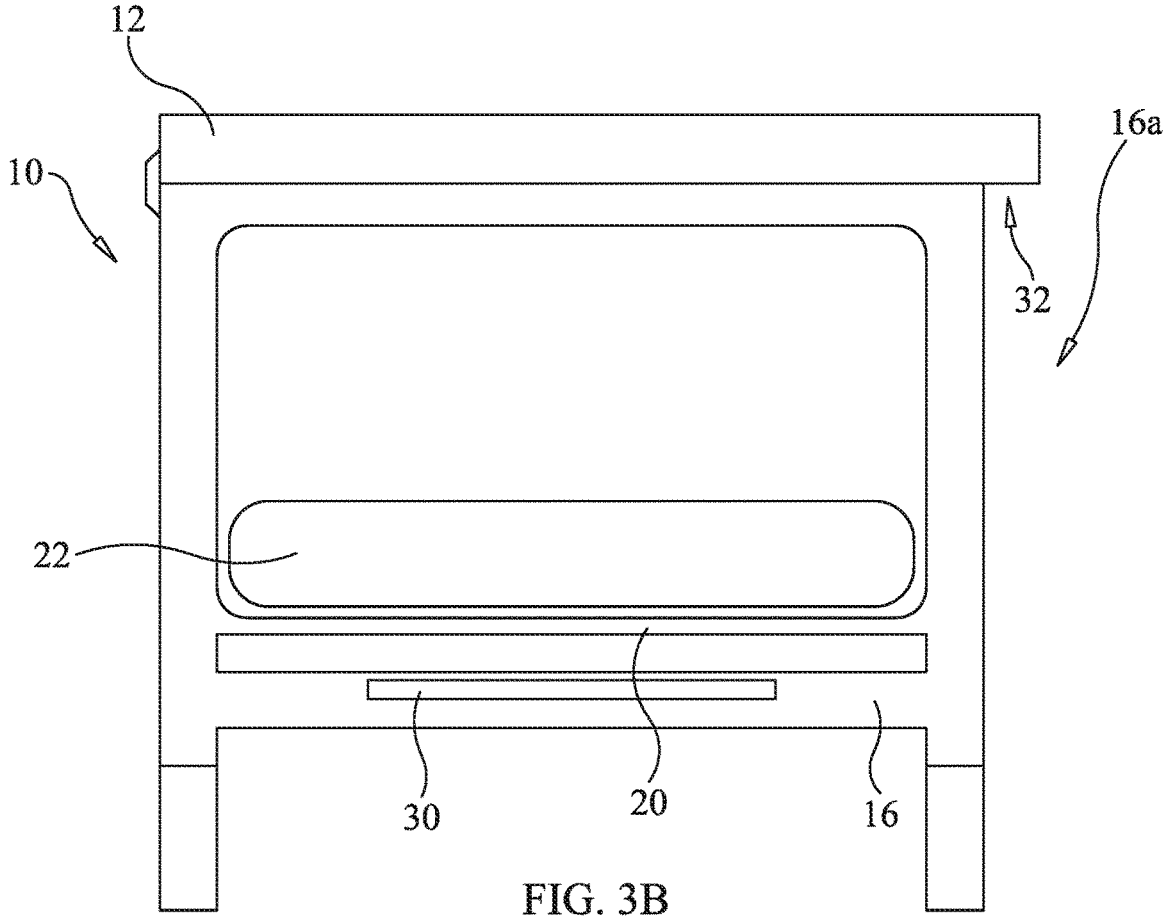
Figure 4:
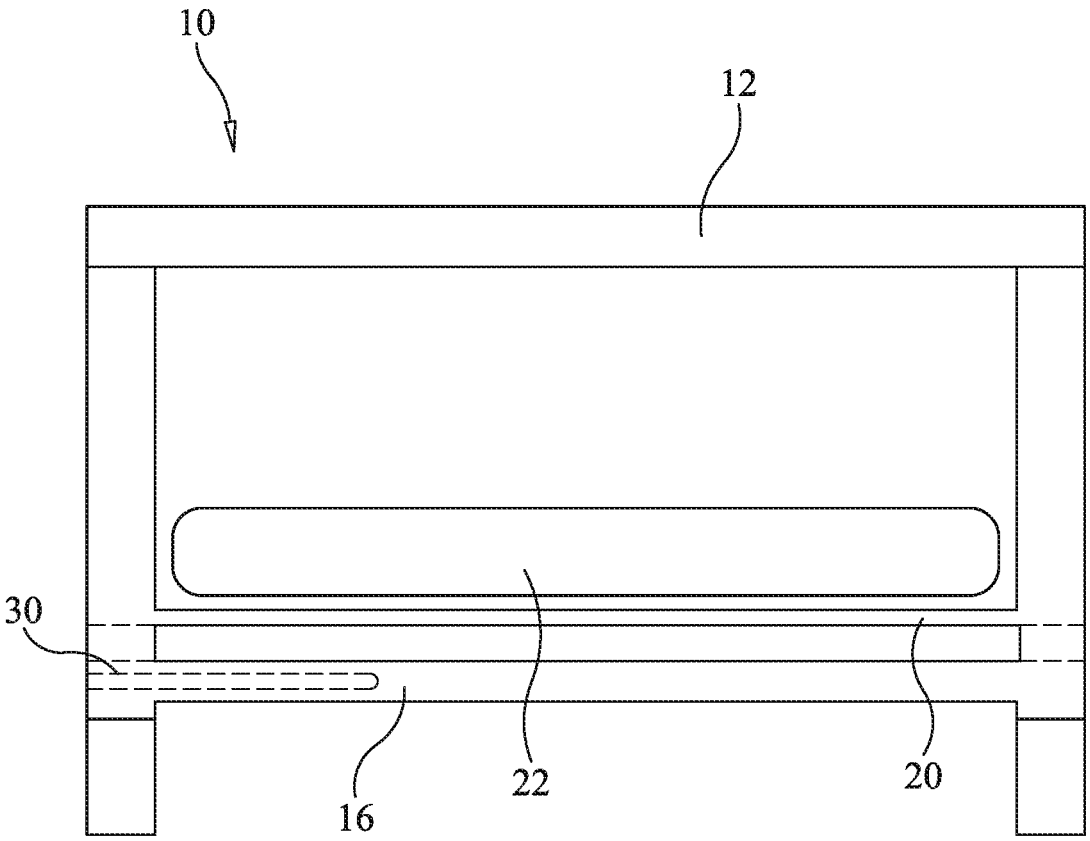
FIG. 4 is a front view of the examination table shown in FIG. 3*b*.

Referring now to FIGS. 3*a* and 3*b*, it will be apparent that end members 18*a* and 18*b* may also take on a variety of configurations and functional options. For example, the end member shown in FIG. 3*a* exemplifies a solid panel design that approximates a church pew style while the end member shown in FIG. 3*b* is presented in an open configuration commonly seen in standard office furniture. Additionally, the end members may be fitted with a variety of features such as storage drawers and extendable trays or steps useful during clinical examination. For example, the end member shown in FIG. 3*a* includes storage drawer 29 that can be used to house clinical supplies or apparatus. Alternatively, FIG. 3*b* includes extendable footstep 30. It will be appreciated from the view shown in FIG. 4 that when the end members are fitted to include a storage drawer or extendable footstep 30 as shown in FIG. 3*b* for example, the base/support frame must be fashioned to spatially accommodate and adequately support those optional structures while simultaneously considering the space required to accommodate seating member 20.

Referring again to FIGS. 3*a* and 3*b*, table member 12 is shown to take on a spatial footprint that is larger than the spatial footprint afforded by base 14 when table member 12 is in the horizontal position. For example, FIG. 5*b* illustrates that table member 12 may have an overhanging portion 32 that extends beyond support frame 16. Accordingly, it will be appreciated that the table member 12 may be liberally extended beyond support frame 16 on the front and at the end members to increase the size of the available examination face so long as the stability of examination table 10 is not compromised. Table member 12 may also be extended at the back of support frame 16 depending upon the type of hinged connector employed to hingedly affixed table member 12 to frame 16.

It will be further appreciated by those skilled in the art that while the end members may be fashioned in a variety of embodiments and must not necessarily be identical to one another even when appearing in the same frame, it will be important that they are of substantially the same height in order to provide adequate support and stability to table member 12 when in a horizontal orientation for performing an examination of the subject. Additionally, end members 18*a* and 18*b* may be integrally formed with frame 16 or may be attached to and become a part of frame 16 by virtue of welds or any other number of suitable and readily available attachment means known in the art.

Figure 6:
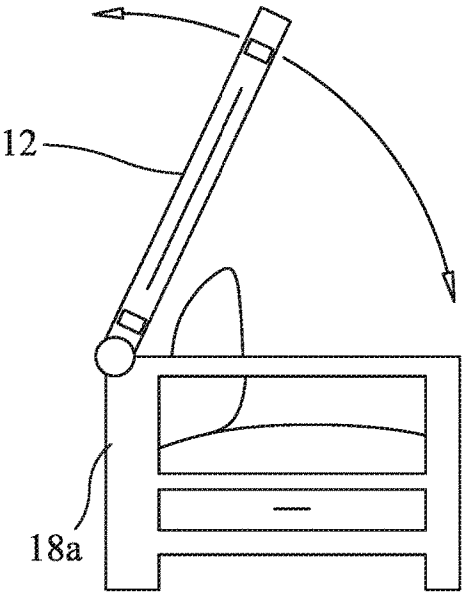
FIGS. 5 through 7 show particular embodiments and optional features of the present invention along with seating member alternatives.
Figure 7:
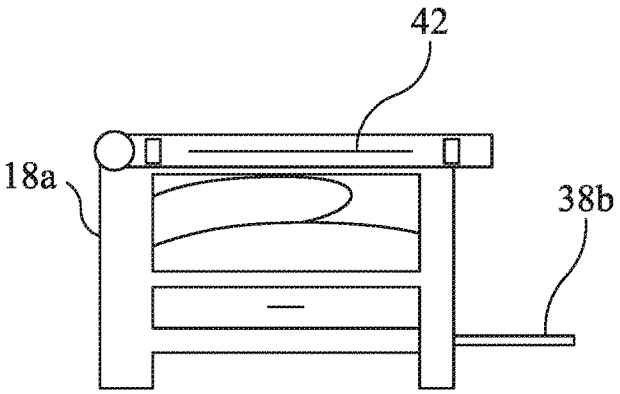
Figure 5:
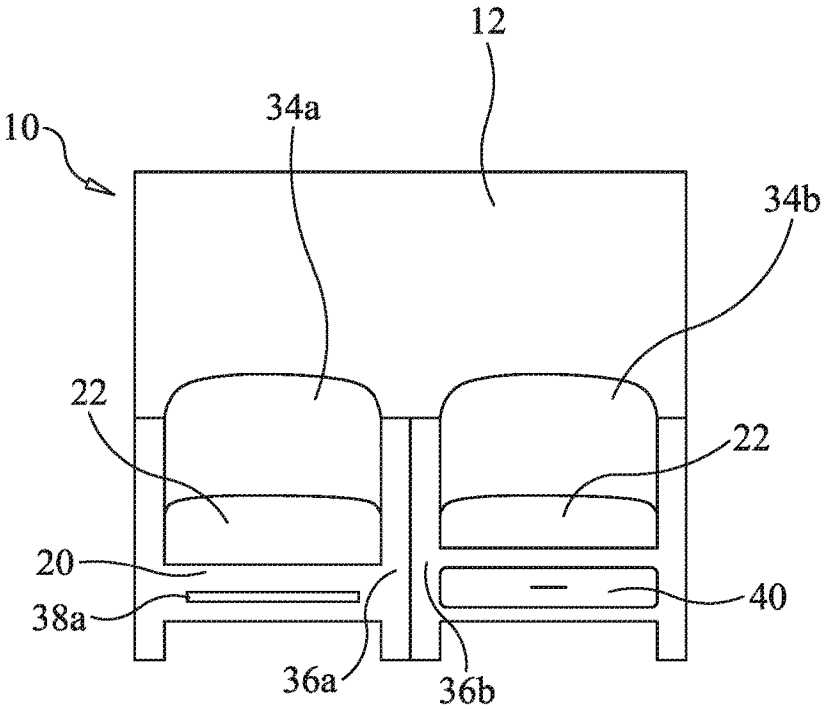

In other embodiments such as that shown in FIG. 5, frame 16 is fabricated with a dual chair seating arrangement wherein the chairs can be affixed to one another during an on-site assembly or otherwise manufactured as an integral unit. As will be readily appreciated from the figures, dual backrest members 34*a* and 34*b* could be fashioned as removable cushions or alternatively manufactured with frame 16 so long as they do not exceed the height of the end members or, alternatively are constructed so that they pivot or fold downward as shown in FIGS. 6 and 7 to meet the seating member which may optionally include cushion members 22. It will be appreciated that the embodiment shown in FIG. 5 contemplates that table member 12 may receive added support in the horizontal orientation from armrest members 36*a* and 36*b* however backrest members 34*a* and 34*b* must either be capable of being quickly removed or be sufficiently sized in order to provide ample clearance for table member 12 to contact end members 18*a* and 18*b* and armrest members 36*a* and 36*b* when backrest members 34*a* and 34*b* are folded forward as depicted in FIGS. 6 and 7. Accordingly, it can be seen how base 14 may be readily adjusted between the seating mode and the examination mode.

Continuing with FIGS. 5 through 7, optional features such as storage drawers and extendable trays or steps may be alternatively placed for access to the front or at the end members of support frame 16 as illustrated by retractable step 38 and storage drawers 40 and 41. In addition, table member 12 may be optionally equipped with a retractable horizontal extension tray 42 as shown in FIG. 7 which can be pulled out to functionally lengthen the area available to perform an examination. Additionally, table member 12 may be equipped with optional quick release clinical apparatus such as ob-gyn stirrups and the like which can be readily and conveniently attached for an examination procedure and quickly removed before table member 12 is returned to a vertical orientation.

It will be appreciated that the base and/or table member may optionally include one or more features to impart added functionality and convenience to the examination table of the present invention. By way of example only, the base and/or table member may be fitted or configured with conventional attachments and fixtures including extendable trays, footsteps and storage drawers as well as medical examination, diagnostic or treatment apparatus or tools. Examples of such apparatus would include pelvic exam stirrups, brackets, holsters or extension arms for supporting the same.

Additionally, the base and/or table member may be fashioned or wired to support a variety of technologies from simple electrical current to complex fiber optic communication devices and medical instrumentation in any number of ways as will be readily appreciated and understood by a person of ordinary skill in the relevant arts. By way of example only, the base and/or table member may be fitted or configured with electrical power outlets as well as ports for connecting and/or charging laptop computers (e.g. USB ports) or other devices such as medical instrumentation. Examples of other useful features would include lighting fixtures, optical viewers (e.g., magnification lenses), oxygen/anesthetic delivery devices, blood pressure and vital sign monitors, and the like.

Despite the selection of various configurations and optional features, it will be appreciated by those skilled in the art of engineering and structural design that various suitable materials are well known and readily available for fabricating support frame 16 and table member 12 when constructing the examination table of the present invention. Such materials include medical grade stainless steel, carbon fiber infused polyalloys, and the like. Moreover, if a more aesthetically pleasing appearance is desired, the frame can of course be fashioned from wood or another material stylistically coordinated with the decor in order to create a more relaxed examination environment.

Additionally, table member 12 may be preferably fabricated to facilitate a clinical evaluation of the subject on one side and to facilitate a pleasing aesthetic environment on the other. It will be readily appreciated that the examination face of table member 12 faces up when the table member is in the horizontal position for an examination and may be fabricated or covered with a variety of medical grade materials from stainless steel to padded surfaces generally suitable for the medical industry.

Figure 8:
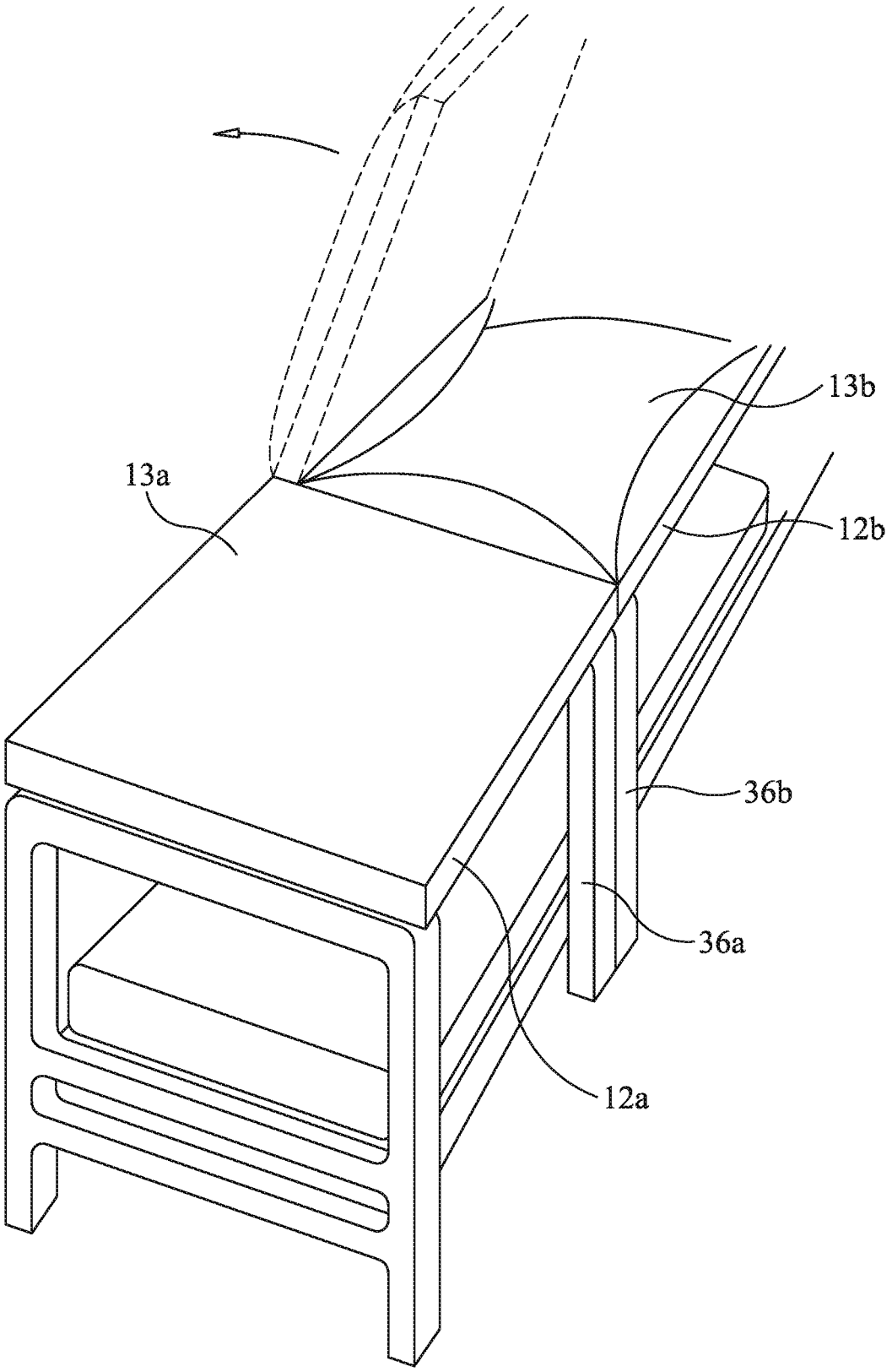
FIG. 8 shows the examination table of the present invention wherein the seating member is fashioned as a 2-chair configuration with the table member divided into sections.

Turning to now to FIG. 8, it can be seen that in embodiments where the base is fabricated utilizing the 2-chair configuration shown in FIG. 5, planar table member 12 may be conveniently split into dual examination tables that may, in turn, have different surface applications such as illustrated by surface 13*a* and 13*b* as deployed on table section 12*a* and 12*b*, respectively. For example, 13*a* is depicted as a smooth surface such as medical grade stainless steel while 13*b* is depicted with as a cushioned surface. It will be further appreciated that armchair members 36*a* and 36*b* may provide the additional support for table member 12 in this particular configuration.

Accordingly, it can be seen from the exemplary embodiments set forth above that the examination table of the present invention is useful in a clinical environment due to its convertibility between an examination configuration for performing a medical examination of a patient and a seating configuration. Prior to a patient initially entering an examination room, the present invention will be preferably placed in a seating configuration wherein the planar table member of the examination table is in the vertical orientation and the planar seating member is accessible for seating the patient. The physician or other member of the hospital or clinic staff will typically invite the patient into the examination room and offer them a seat on the horizontal seating surface as provided by the invention. At this point in the patient's examination room experience, the physician or other staff member may engage in a more relaxed conversation about the patient's health or any pertinent health history, clinical symptoms, laboratory or imaging results, upcoming procedures, hospital stays, treatment plans, disease progression, prognosis or the like.

The environment afforded by the present invention is especially advantageous when the physician or other staff member may have to discuss sensitive or emotional issues associated with the foregoing. At any point in the patient-physician/staff interaction, the present invention may be readily converted from the seating configuration to the examination configuration by pivoting the table member of the present invention from the vertical orientation forward to the horizontal orientation once any back-rest members that may be present in the embodiment have been removed or folded forward. In this manner, the physician or staff member may make a fluid transition between a more relaxed, conversational environment to a more clinical, technical environment.

While the invention has been described in its preferred forms or embodiments with some degree of particularity, it is understood that the detailed description as set forth herein has been provided only by way of example and that numerous modifications, changes, variations, substitutions and equivalents may be available as well as alternative details regarding construction, fabrication, and use, including the combination and arrangement of parts, all of the foregoing being readily apparent to those skilled in the art without departing from the spirit and scope of the present invention as described and claimed.

I claim:

1. An examination table comprising:

at least one planar table member having an examination face and a non-examination face, the table member adjustable between a horizontal orientation for medical evaluation of a patient and a vertical orientation; and a base fashioned as a support frame for supporting the table member when horizontally oriented, the base comprising a front frame support member, a first end member and a second end member, a back frame support member horizontally interposed between and connected to the first and second end members, forming a substantially rectangular, free-standing structure, wherein the front frame support member and first and second end members are substantially vertically oriented relative to a floor and the first and second end members and back frame support member being of substantially the same height to provide support for the planar table member when in the horizontal orientation; and at least one substantially planar seating member disposed between and connected to the support frame to form a horizontal seating surface suitable for seating patients;

wherein the table member is hingedly affixed to the horizontally interposed back frame support member, allowing the table member to move between the vertical and horizontal orientations, whereby the examination face of the table member faces up when the table member is pivoted forward to the horizontal orientation and affords access to the horizontal seating surface when in the vertical orientation.

2. The examination table of claim 1 wherein the examination face of the table member comprises padding.

3. The examination table of claim 1 wherein the examination face of the table member is stainless steel.

4. The examination table of claim 1 wherein the table member includes at least one extension tray.

5. The examination table of claim 1 wherein the base includes at least one extendable footstep.

6. The examination table of claim 1 wherein the base includes at least one storage drawer.

7. The examination table of claim 1 wherein the back frame support member is a solid panel.

8. The examination table of claim 1 wherein the back frame support member is a backrest.

9. The examination table of claim 1 wherein the back frame support member provides support for a backrest member.

10. The examination table of claim 9 wherein the backrest member folds forward.

* * * * *